US010317172B1

(12) United States Patent
Morgan et al.

(10) Patent No.: US 10,317,172 B1
(45) Date of Patent: Jun. 11, 2019

(54) IN-CHAMBER LASER BORESIGHT DEVICE

(71) Applicant: Range Tactics LLC, Genesee Depot, WI (US)

(72) Inventors: Wayne B. Morgan, Lincoln, NE (US); Richard D. Lindlau, Waukesha, WI (US); Daniel R. A. Harder, Hartland, WI (US)

(73) Assignee: Range Tactics LLC, Genesee Depot, WI (US)

( * ) Notice: Subject to any disclaimer, the term of this patent is extended or adjusted under 35 U.S.C. 154(b) by 0 days.

(21) Appl. No.: 15/807,388

(22) Filed: Nov. 8, 2017

Related U.S. Application Data

(60) Provisional application No. 62/385,317, filed on Sep. 9, 2016.

(51) Int. Cl.
*F41G 1/54* (2006.01)

(52) U.S. Cl.
CPC ..... *F41G 1/545* (2013.01)

(58) Field of Classification Search
CPC ..... F41A 33/02; F41G 1/54
USPC ..... 42/116, 117
See application file for complete search history.

(56) References Cited

U.S. PATENT DOCUMENTS 4,079,534 A * 3/1978 Snyder ..... F41G 1/35 362/110
5,119,576 A * 6/1992 Erning ..... F41A 33/02 362/111
5,365,669 A * 11/1994 Rustick ..... F41A 33/02 33/DIG. 21
5,454,168 A * 10/1995 Langner ..... F41G 1/545 356/153
2011/0047847 A1* 3/2011 Hughes ..... F41A 19/16 42/1.01
2011/0219658 A1* 9/2011 AlKandari ..... F41G 1/54 42/116

* cited by examiner

*Primary Examiner* — Bret Hayes
(74) *Attorney, Agent, or Firm* — Suiter Swantz pc llo

(57) ABSTRACT

A boresight device includes a casing designed to be loaded into a chamber of a firearm in the place of a bolt carrier group. The casing may include one or more keyed features to engage with corresponding components of the firearm such that the one or more keyed features align an exit port in the casing to a barrel of the firearm upon loading of the casing into the chamber. The boresight device may further include a laser device for generating a laser beam. The laser device is positioned within the casing to direct the laser beam through the exit port of the casing and along an axis of the barrel when the casing is loaded into the chamber.

20 Claims, 8 Drawing Sheets

IN-CHAMBER LASER BORESIGHT DEVICE

CROSS-REFERENCE TO RELATED APPLICATION

The present application claims the benefit under 35 U.S.C. § 119(e) of U.S. Provisional Application Ser. No. 62/385,317, filed Sep. 9, 2016, entitled UNIQUE AND NOVEL LASER BORESIGHT DEVICE AND METHOD FOR USING DESCRIBED LASER BORESIGHT DEVICE FOR THE SIGHTING-IN AND ZEROING OF RIFLES OF THE M-16, AR-15 AND SIMILAR DESIGN AND IN ANY CALIBER, naming Wayne B. Morgan, Richard D. Lindlau, and Daniel R. A. Harder as inventors, which is incorporated herein by reference in the entirety.

TECHNICAL FIELD

The present disclosure is related generally to the field of firearm sighting and, more particularly, to laser boresight devices.

BACKGROUND

Boresight devices facilitate the alignment of a barrel of a firearm to a sighting device, or "boresighting" the firearm. Boresighting is typically used to provide efficient zeroing (or sighting in) of a firearm, which consists of aligning the point of impact of a bullet with a point of aim of a sighting device.

The trajectory of a bullet from a firearm may generally depend on a variety of factors such as, but not limited to, firearm type, bullet caliber, bullet speed, target distance, wind direction, and wind speed. Zeroing may typically include firing one or more rounds of ammunition at a target and aligning the sighting device to the point of impact. If the sighting device is far from alignment, multiple zeroing iterations may be required. However, this process may be time-consuming and waste costly ammunition.

Boresight devices may provide efficient zeroing by providing an initial alignment of the sighting device to the barrel. For example, a boresight device may typically be used to align the barrel to a sighting device for a target at a selected distance (e.g., 25 meters) at which a bullet trajectory may approximate a straight line from the barrel to the target. A user may then further refine the sighting alignment to zero the firearm at any distance to account for deviations of the bullet trajectory.

However, typical boresight devices may be cumbersome, inaccurate, difficult to align, and/or may suffer from limited battery life. It is therefore desirable to provide systems and methods for improved boresighting.

SUMMARY

A boresight device is disclosed, in accordance with one or more illustrative embodiments of the present disclosure. In one illustrative embodiment, the boresight device includes a casing designed to be loaded into a chamber of a firearm in the place of a bolt carrier group. The casing may include one or more keyed features to engage with corresponding components of the firearm such that the one or more keyed features align an exit port in the casing to a barrel of the firearm upon loading of the casing into the chamber. In another illustrative embodiment, the boresight device includes a laser device configured to generate a laser beam. The laser device may be positioned within the casing to direct the laser beam through the exit port of the casing and along an axis of the barrel when the casing is loaded into the chamber.

A boresight device is disclosed, in accordance with one or more illustrative embodiments of the present disclosure. In one illustrative embodiment, the boresight device includes a casing designed to be loaded into a chamber of a firearm in the place of a bolt carrier group. The casing may be designed to accept a laser device for generating a laser beam. The casing may include one or more keyed features to engage with corresponding components of the firearm to align an exit port in the casing to a barrel of the firearm upon loading of the casing into the chamber such that the laser beam propagates through the exit port along an axis of the barrel.

A boresight device comprising is disclosed, in accordance with one or more illustrative embodiments of the present disclosure. In one illustrative embodiment, the boresight device includes a casing designed to be loaded into a chamber of a firearm in the place of a bolt carrier group. The casing may include one or more keyed features to engage with corresponding components of the firearm such that the one or more keyed features align an exit port in the casing to a barrel of the firearm upon loading of the casing into the chamber. In another illustrative embodiment, the boresight device includes a user-swappable laser device configured to generate a laser beam. The user-swappable laser device may further be positioned within the casing to direct the laser beam through the exit port and along an axis of the barrel when the casing is loaded into the chamber. In another illustrative embodiment, the boresight device includes a laser power actuator providing a user-accessible interface for actuating the user-swappable laser device when the casing is loaded into the chamber. In another illustrative embodiment, the boresight device includes a removable cap providing access for removal and insertion of the user-swappable laser device.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and, together with the general description, serve to explain the principles of the invention.

BRIEF DESCRIPTION OF DRAWINGS

The numerous advantages of the disclosure may be better understood by those skilled in the art by reference to the accompanying figures in which.

DETAILED DESCRIPTION

Figure 1:
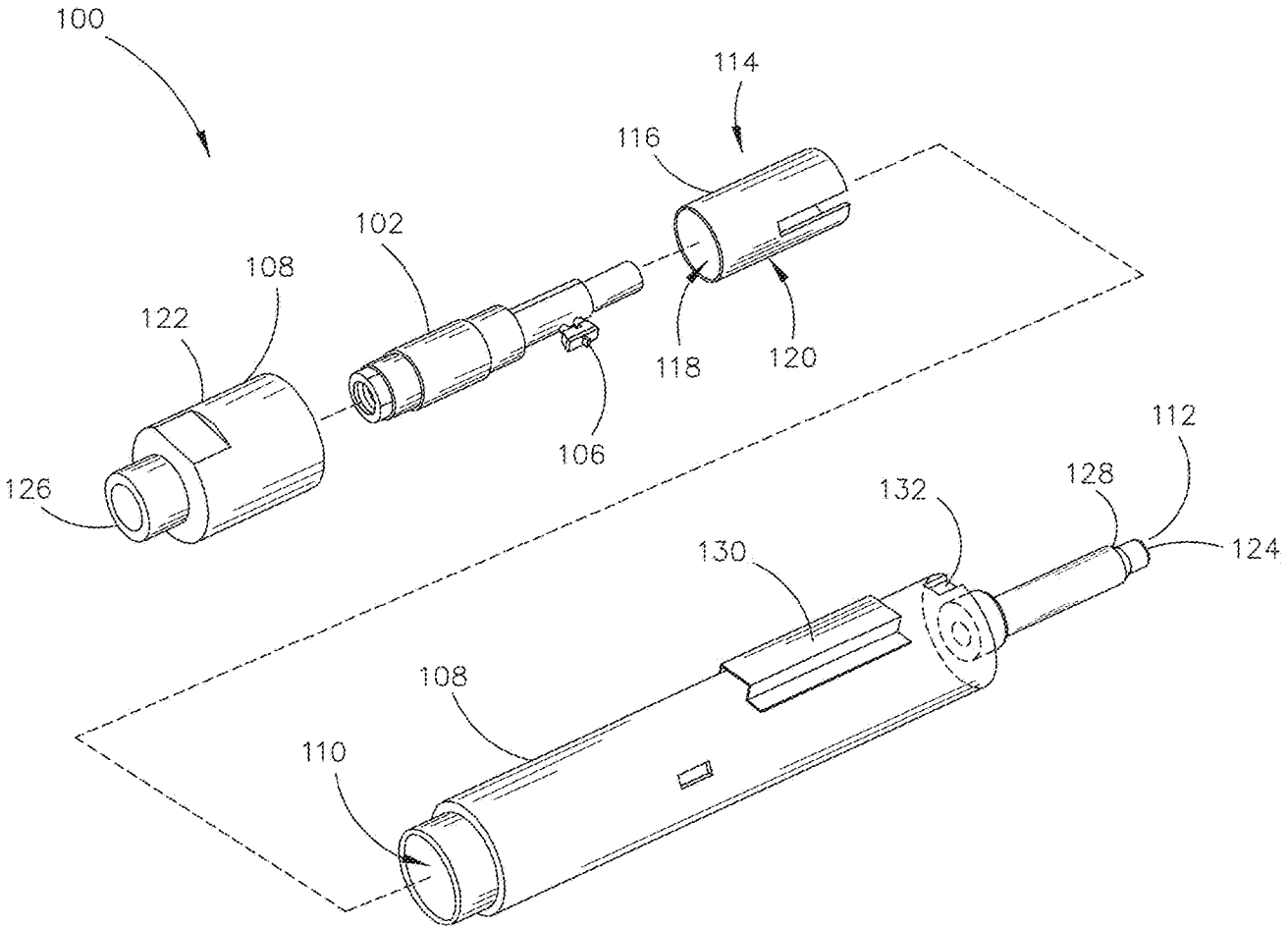
FIG. 1 is an exploded perspective view of a boresight device, in accordance with one or more embodiments of the present disclosure.

Reference will now be made in detail to the subject matter disclosed, which is illustrated in the accompanying drawings. The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Embodiments of the present disclosure are directed to systems and methods for boresighting a firearm by loading a boresight device into the chamber of a firearm in the place of a bolt carrier group, whereupon the boresight device may propagate a laser beam through the barrel of the firearm for alignment with a sighting device.

Boresighting typically requires two stages of alignment to properly align a sighting device to the barrel of a firearm. First, a boresight device must be aligned to the barrel. For example, a laser boresight device must be aligned such that a laser beam may propagate along an axis of the barrel (e.g., a center axis of the barrel, an axis parallel to the center axis, or the like). Second, the sighting device must be aligned to the point of impact of the laser beam on a target at a selected distance.

Embodiments of the present disclosure are directed to a laser boresight device designed to be loaded into the chamber of a firearm. In this regard, the laser boresight device may direct a laser beam through the length of the barrel towards a target. Additional embodiments of the present disclosure are directed to a boresight device with one or more keyed features that engage with corresponding features of the firearm to provide self-alignment of the laser beam with an axis of the barrel when loaded into the firearm.

Additional embodiments of the present disclosure are directed to a boresight device designed to be loaded into the chamber of a firearm in the place of a bolt carrier group. Many firearms, such as, but not limited to, M-16 rifles, AR-15 rifles, or the like include a bolt carrier group that may be easily and quickly removed to provide access to the chamber. Further, the dimensions and features of the bolt carrier group are keyed to provide self-alignment within the chamber for reliable operation. For example, the bolt carrier group may be generally cylindrically shaped with an outer diameter closely matched to the inner diameter of the chamber such that the bolt carrier group may controllably slide back and forth within the chamber during firing with minimal wobble. Further, the bolt carrier group may include one or more rails, grooves, protrusions, cut-outs, or the like to engage with components such as, but not limited to, the charging handle, the end face of the barrel, or a gas return line.

Embodiments of the present disclosure are directed to a boresight device having dimensions and/or keyed features to engage with the firearm in a similar manner as a bolt carrier group. In this regard, the boresight device may self-align the path of a laser beam to the axis of the barrel when loaded into the chamber without additional alignment by the user.

It is recognized herein that a boresight device providing self-alignment with the barrel of a firearm (e.g., the first alignment step of boresighting) may facilitate efficient operation of the boresight device itself without the need for user training on the operation of the device. For example, a user may simply remove the bolt carrier group, insert the boresight device, power on the laser beam, aim the laser beam at the target, and align the sighting device to the target (e.g., the second alignment step of boresighting). Further, a boresight device providing self-alignment with the barrel of the firearm may be rapidly switched between multiple firearms. Accordingly, the boresight device may be used to boresight many (e.g., greater than 100) firearms in a day and may thus be suitable for reliable and fast in-field military operations.

It is further recognized herein that a laser boresight device inserted into the chamber in the place of a bolt carrier group may provide highly accurate self-alignment of the laser beam with the axis of the barrel with without the time, effort, or uncertainty associated with manually aligning the boresight device to the barrel during the first alignment step. Accordingly, a boresight device inserted into the chamber in the place of a bolt carrier group may provide a higher accuracy than typical laser boresight devices such as, but not limited to, those placed within the firing end of a barrel or those shaped as bullets and loaded into the firearm. For example, boresight devices inserted into the firing end of the rifle may sag due to weight protruding from the end of the barrel, loose fit within the barrel, or the like. Further, boresight devices inserted into the barrel pose a risk of physically damaging the barrel (e.g., via abrasions, chips, or the like), particularly through repeated use, that may ultimately reduce the firing accuracy of the firearm. By way of another example, boresight devices shaped as ammunition loaded into the firearm may have dimensions that do not precisely match the inner diameter of the barrel and/or do not precisely match the type of ammunition to be used, which may lead to inaccurate alignment and unreliable operation. In contrast, a boresight device inserted into the chamber in the place of a bolt carrier group may be rigidly fixed within the chamber (e.g., by pressure from the recoil spring, snug fit within the chamber, keyed features, or the like) and may thus not exhibit sag and/or wobble that may lead to alignment errors. Further, the length of a boresight device designed to replace a bolt carrier group may be, but is not required to be, 30-50 millimeters, which may provide substantial interaction length with the chamber for accurate self-alignment with the firearm.

Additional embodiments of the present disclosure are directed to a boresight device with laser power switch accessible when loaded into the chamber of a firearm. For example, the boresight device may have a laser power switch accessible through a chamber door. By way of another example, the boresight device may have a laser power switch that may be actuated by a component of the firearm such as, but not limited to, the safety switch or the trigger/hammer. In this regard, a user may selectively actuate the power of the laser with the device inserted into the firearm, which may facilitate safe operation and minimize stray reflections of the laser beam into the eyes of the user and/or any bystanders.

The boresight device may be powered by any power source known in the art such as, but not limited to, batteries (e.g., single-use or rechargeable) or an external power supply. It is recognized herein that a boresight device designed to be loaded into the chamber in the place of a bolt carrier group may be powered by long-lasting and/or rechargeable batteries suitable for extended use, which may facilitate prolonged field use of the boresight device. In particular, boresight device the size of a bolt carrier group may be, but is not required to be, sufficient to provide for a wide variety of battery form factors such as, but not limited to, C, AA, AAA, AAAA, or button.

It is further recognized herein that a boresight device may be used for a variety of purposes beyond zeroing a firearm. For example, a boresight device in which a laser beam may be selectively actuated by the user (e.g., via the trigger) may provide ammunition-less training in which a point of impact of the laser beam is gauged as a fire rather than the point of impact of a round of fired ammunition.

Figure 2:
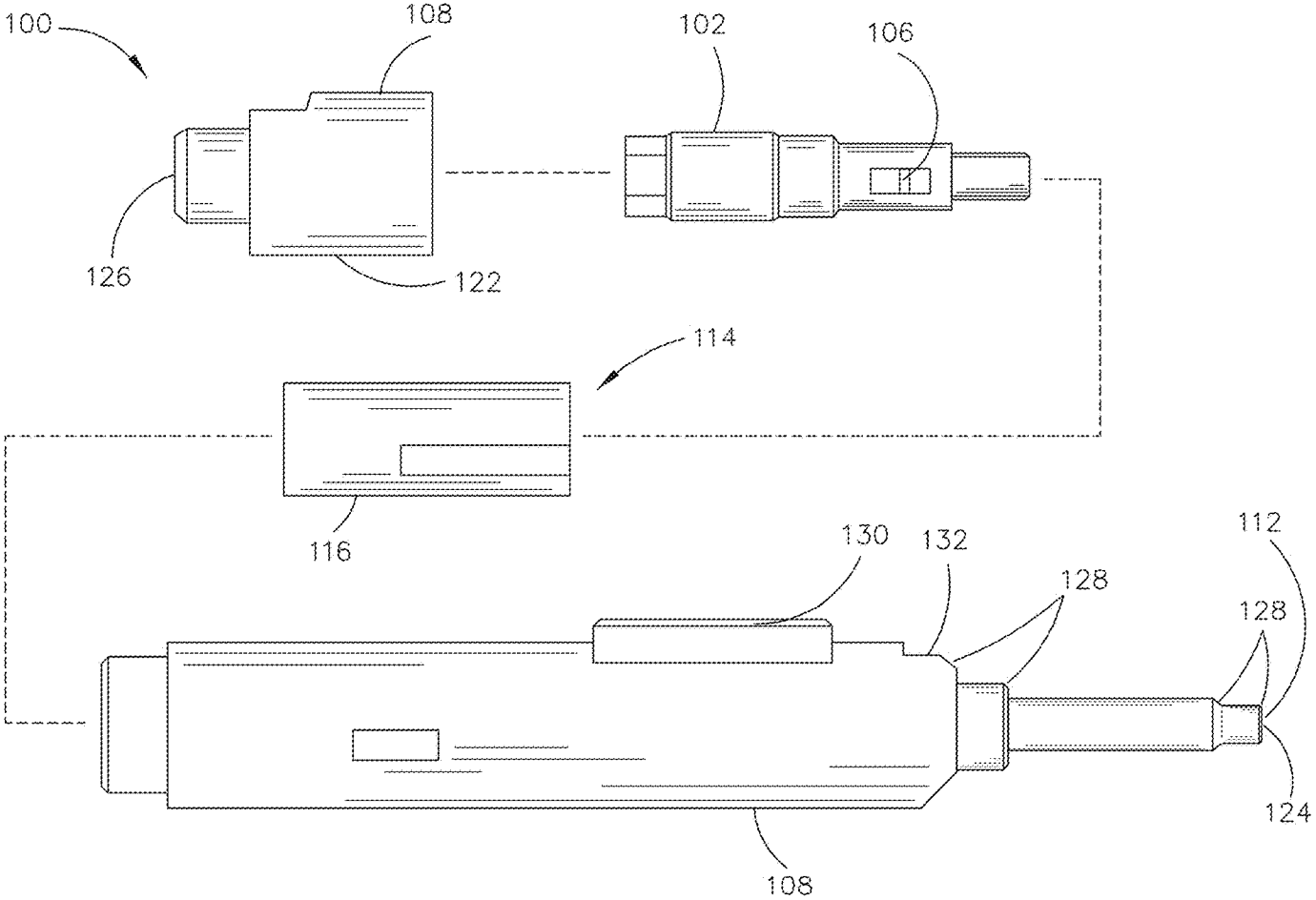
FIG. 2 is an exploded orthogonal view of a boresight device, in accordance with one or more embodiments of the present disclosure.
Figure 3:
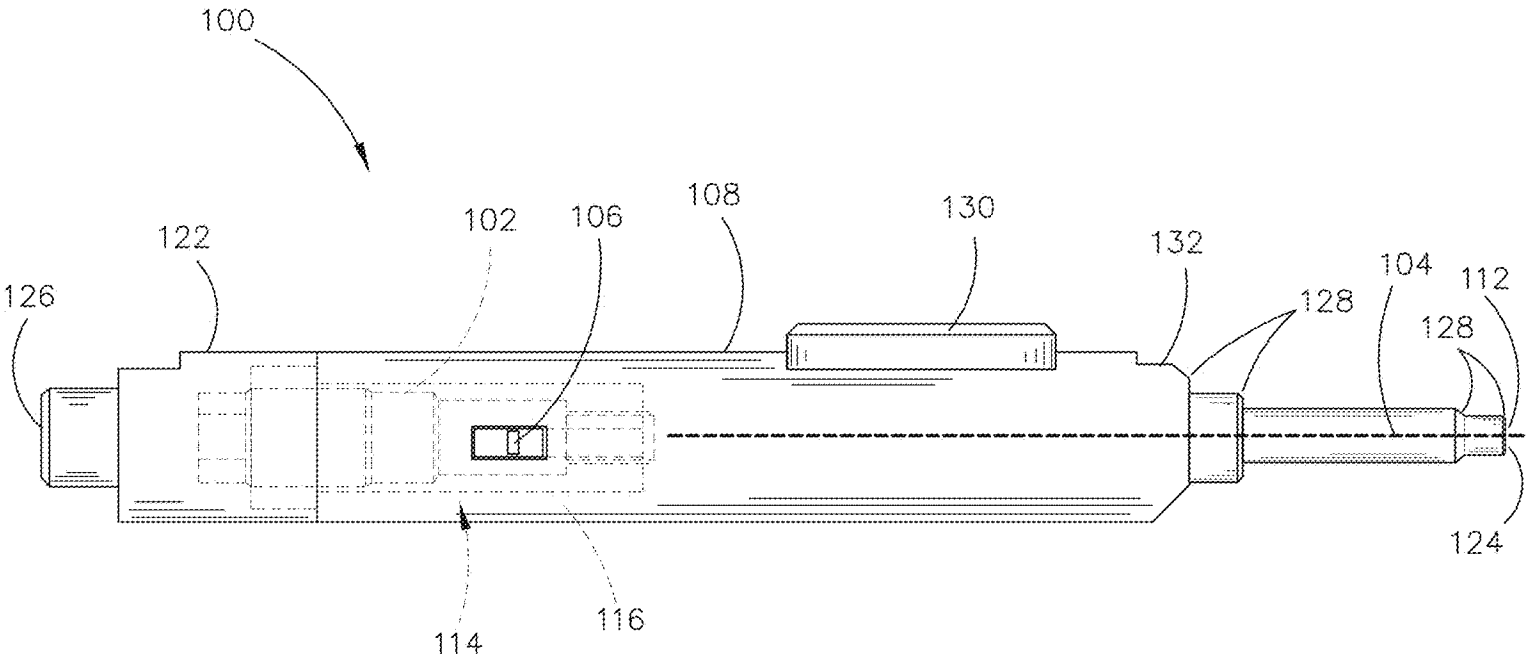
FIG. 3 is an orthogonal assembled view of a boresight device, in accordance with one or more embodiments of the present disclosure.

Referring now to FIGS. 1 through 3, a boresight device designed to be loaded into a chamber of a firearm is generally shown. FIG. 1 is an exploded perspective view of a boresight device 100, in accordance with one or more embodiments of the present disclosure. FIG. 2 is an exploded orthogonal view of the boresight device 100, in accordance with one or more embodiments of the present disclosure. FIG. 3 is an orthogonal assembled view of the boresight device 100, in accordance with one or more embodiments of the present disclosure.

In one embodiment, the boresight device 100 includes a laser device 102 suitable for generating a laser beam 104. Further, the laser beam 104 may include any wavelength or combination of wavelengths. For example, the laser device 102 may generate a laser beam 104 including one or more visible wavelengths such as, but not limited to, red, yellow, green, or blue wavelengths. Such wavelengths are typically visible to the human eye and may be readily seen on an alignment target. By way of another example, the laser device 102 may generate a laser beam 104 including one or more wavelengths typically not detectable with the human eye such as, but not limited to, infrared (IR) wavelengths. In one instance, the laser beam 104 may include infrared wavelengths that may be classified as "eye-safe" at certain power levels (e.g., due to an inability of the human eye to focus a beam of such light onto the retina). In this case, the laser beam 104 may generate visible light when incident on a target through fluorescence or a similar process. Alternatively, the laser beam 104 may be viewed using additional viewing equipment such as, but not limited to, an IR camera, or an IR viewer (e.g., a "night-vision" viewer).

The laser device 102 may be any type of laser suitable for generating the laser beam 104. In one embodiment, the laser device 102 includes a laser diode suitable for directly generating laser light at a desired wavelength. For example, the laser device 102 may include an aluminum-gallium-indium-phosphide (AlGaInP) laser diode for generating a laser beam at wavelengths in the range of 630-650 nm, or red wavelengths. In another embodiment, the laser device 102 includes a diode-pumped solid-state (DPSS) laser in which a laser diode generates light that pumps a solid-state material (e.g., a crystal) that in turn generates wavelengths of interest (e.g., 671 nm). In another embodiment, the laser device 102 may include a gas laser such as, but not limited to, a helium-neon laser. In another embodiment, the laser device 102 includes a frequency-conversion component to generate one or more desired wavelengths through nonlinear optical interactions such as, but not limited to, frequency doubling or four-wave mixing. For example, green laser light at a wavelength of 532 nm may be, but is not required to be, generated by a three-step DPSS process in which a laser diode emits 808 nm light, which pumps a nonlinear crystal (e.g., neodymium-doped yttrium aluminum garnet (Nd:YAG), neodymium-doped yttrium orthovanadate (Nd:$YvO_4$), or the like) to generate 1064 nm laser light, which is then frequency-doubled in a nonlinear crystal (e.g., lithium triborate (LBO), potassium titanyl phosphate (KTP), or the like) to generate the 532 nm laser light. Similar processes may be utilized to generate any desired wavelength or range of wavelengths by the laser device 102. In a general sense, the laser device 102 may utilize any mechanism to generate a laser beam 104 suitable for boresighting.

The laser device 102 may be powered by any power source known in the art such as, but not limited to, batteries (e.g., single-use or rechargeable) or an external power supply. For example, batteries suitable for powering the boresight device may include, but are not limited to, alkaline, silver cell, nickel-cadmium, lithium-ion, or zinc-carbon. Further, batteries suitable for powering the boresight device may have any shape or form-factor known in the art, such as, but not limited to, C, AA, AAA, AAAA, or button.

In another embodiment, the laser device 102 includes a laser power actuator 106. The laser power actuator 106 may include any component known in the art suitable for providing a user interface for the adjustment of the power of the laser beam 104 such as, but not limited to, a button, a switch, or a dial. For example, the laser power actuator 106 may toggle the laser beam 104 on and off. By way of another example, the laser power actuator 106 may provide intensity control of the laser beam 104. Further, the laser power actuator 106 may be accessible on the exterior of the casing 108 such that a user may interface with the laser power actuator 106 while the boresight device 100 is fully assembled. In another embodiment, the laser power actuator 106 includes a wireless transmitter/receiver suitable for providing wireless control of the laser beam 104. For example, the laser power actuator 106 may operate wirelessly using any frequency and/or protocol known in the art such as. For example, the laser power actuator 106 may include a radio frequency (RF) transmitter/receiver operating on any frequency such as, but not limited to 315 MHz. By way of another example, the laser power actuator 106 may include a Bluetooth transmitter/receiver.

In another embodiment, the boresight device 100 includes a casing 108 to house the laser device 102. For example, the casing 108 casing may include an enclosure with a cavity 110 suitable for containing the laser device 102. The casing 108 may be fabricated from any material suitable for insertion into the chamber of a firearm. For example, the casing 108 may be fabricated at least in part out of a metal such as, but not limited to, aluminum or stainless steel. Further, the casing 108 may be treated with a coating and/or a hardening process (e.g., peening, or the like), which may provide increased durability and/or reliable operation for many uses. By way of another example, the casing 108 may be fabricated at least in part out of glass-filled nylon.

In another embodiment, the casing 108 includes an exit port 112 to allow the laser beam 104 generated by the laser device 102 to propagate out of the casing 108. For example, the exit port 112 may include an open hole through which the laser beam 104 may propagate. By way of another example, the exit port 112 may include a window formed from a material at least partially transparent to the wavelength of the laser beam 104. The window may be formed from any material known in the art suitable for transmitting a laser beam 104 such as, but not limited to, a glass (e.g., fused silica, borosilicate glass, or the like), a crystal (e.g., quartz, sapphire, or the like), or a plastic material.

In another embodiment, the boresight device 100 includes one or more laser positioning devices 114. For example, as illustrated in FIGS. 1-3, the one or more laser positioning devices 114 may include a guide lug 116 to mechanically couple the laser device 102 to the casing 108. In this regard, the interior portion 118 of the guide lug 116 may accept at least a portion of the laser device 102 and an exterior portion 120 of the guide lug 116 may couple with an interior wall of the casing 108. Accordingly, the guide lug 116 may secure may secure the laser device 102 within the casing 108. By way of another example, though not shown, the one or more laser positioning devices 114 may include one or more adjustable components (e.g., alignment screws, or the like) to adjust the path of the laser beam 104. In this regard, a user may adjust the direction that the laser beam 104 exits the exit port 112.

In another embodiment, as illustrated in FIGS. 1-3, the casing 108 includes a removable end cap 122 to provide access to the cavity 110 of the boresight device 100. For example, the end cap 122 may provide a user with access to insert, remove, and/or adjust the laser device 102. A user may thus selectively replace the laser device 102 to provide a laser beam 104 with a selected output wavelength, a selected laser intensity, or the like. In one instance, an adjustable guide lug 116 may accommodate multiple laser devices 102 with different form factors. In another instance, a dedicated guide lug 116 may be used for each form factor. Further, the end cap 122 may provide a user with access to insert, remove, and/or replace a battery to power the laser device 102. In another embodiment, though not shown, the boresight device 100 includes an integrated laser device 102. For example, the laser device 102 may not be removable. Further, the casing 108 may be configured without a removable guide lug 116 and may directly couple to the integrated laser device 102.

In another embodiment, the boresight device 100 includes one or more optical elements to control and/or modify the laser beam 104 from the laser device 102 such as, but not limited to one or more lenses, filters, or polarizers. The one or more optical elements may be integrated within any component the boresight device 100 such as, but not limited to, the laser device 102 itself, the cavity 110, the guide lug 116, or the exit port 112. For example, the boresight device 100 may include one or more filters to modify the spectral or spatial characteristics of the laser beam 104. In one instance, the boresight device 100 may include a spectral filter to at least partially reduce the intensity of one or more wavelengths of light generated by the laser device 102. For example, a laser device 102 including a nonlinear crystal may output a desired wavelength (e.g., visible green or blue wavelengths) as well as unconverted wavelengths (e.g., IR wavelengths). Accordingly, a spectral filter may selectively transmit the desired wavelengths and reflect and/or absorb undesired wavelengths. In another instance, the boresight device 100 may include a spatial filter and/or one or more optical elements to shape the beam profile of the laser beam 104.

Figure 4:
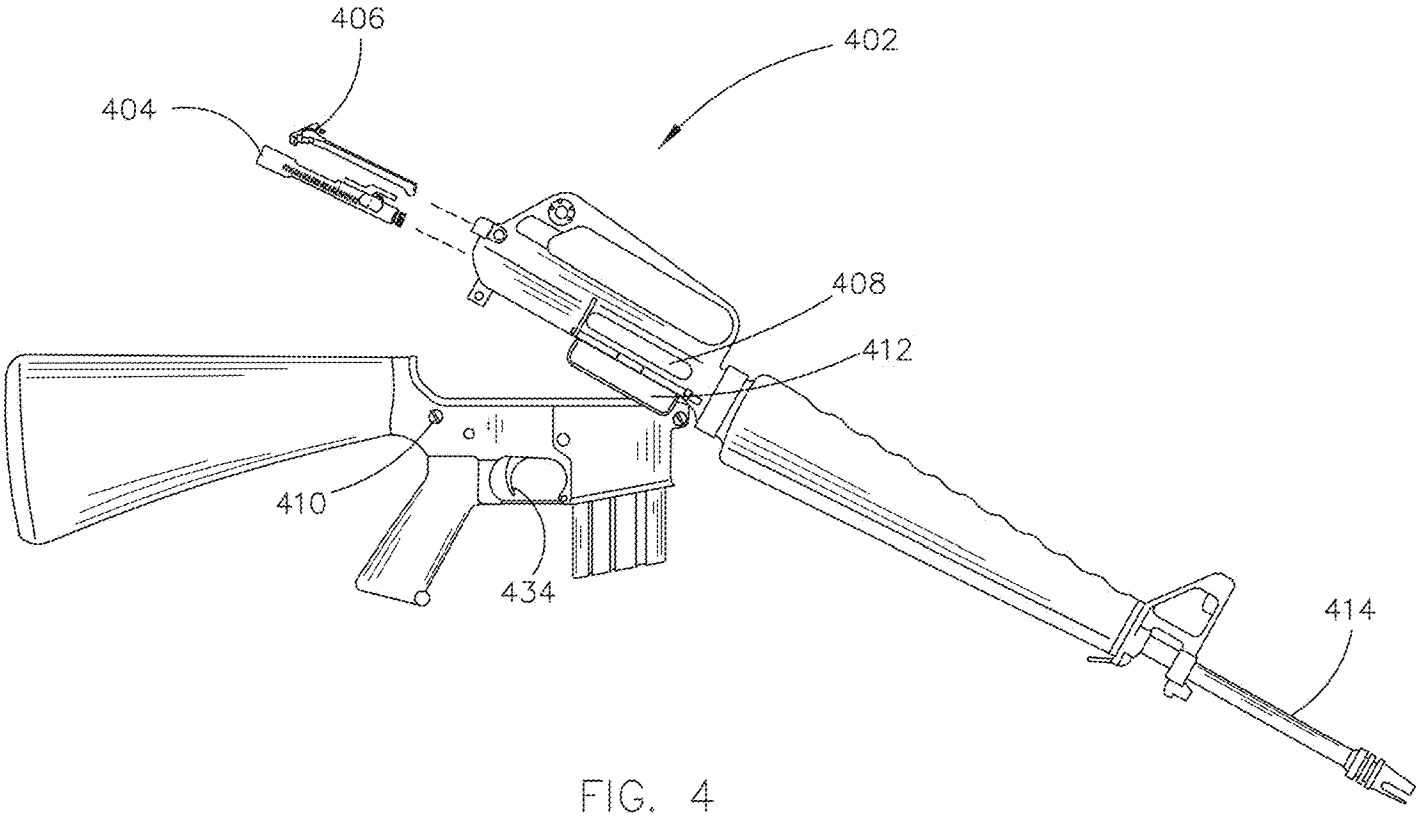
FIG. 4 is an exploded side view of an M-16 firearm in an opened position illustrating a bolt carrier group and a charging handle removed to provide access to a chamber of the firearm, in accordance with one or more embodiments of the present disclosure.
Figure 5:
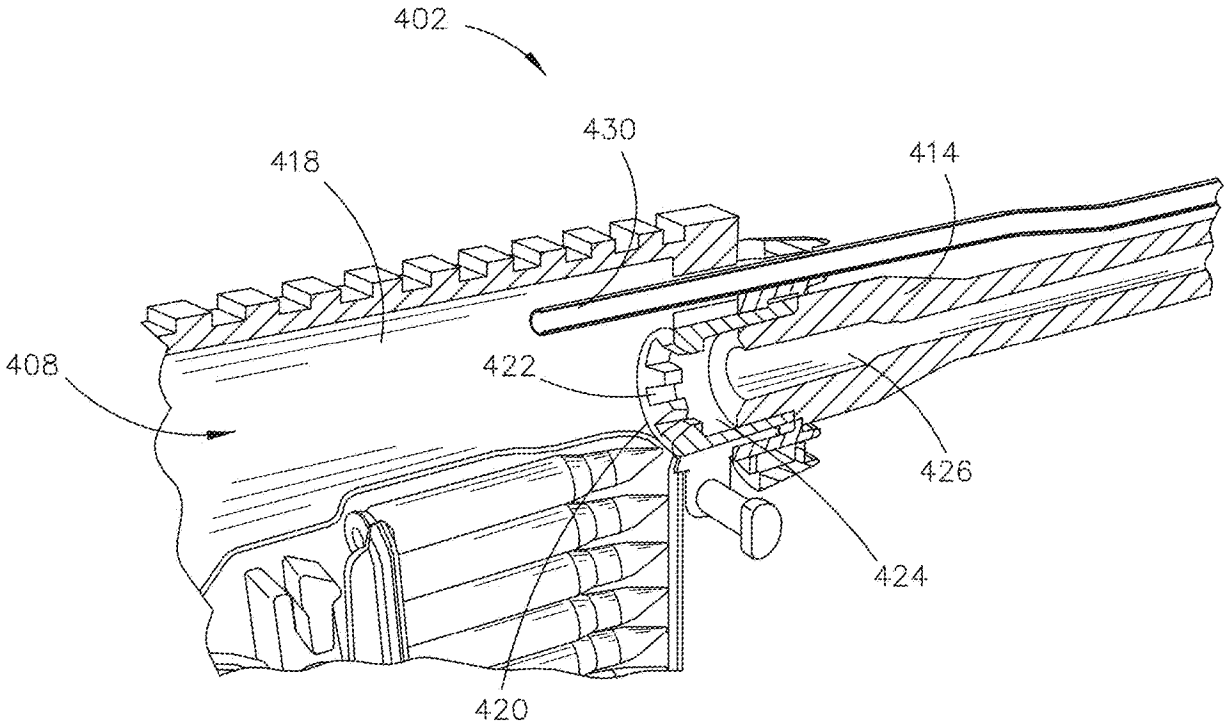
FIG. 5 is a perspective cut-out view of an empty chamber of a firearm, in accordance with one or more embodiments of the present disclosure.
Figure 6:
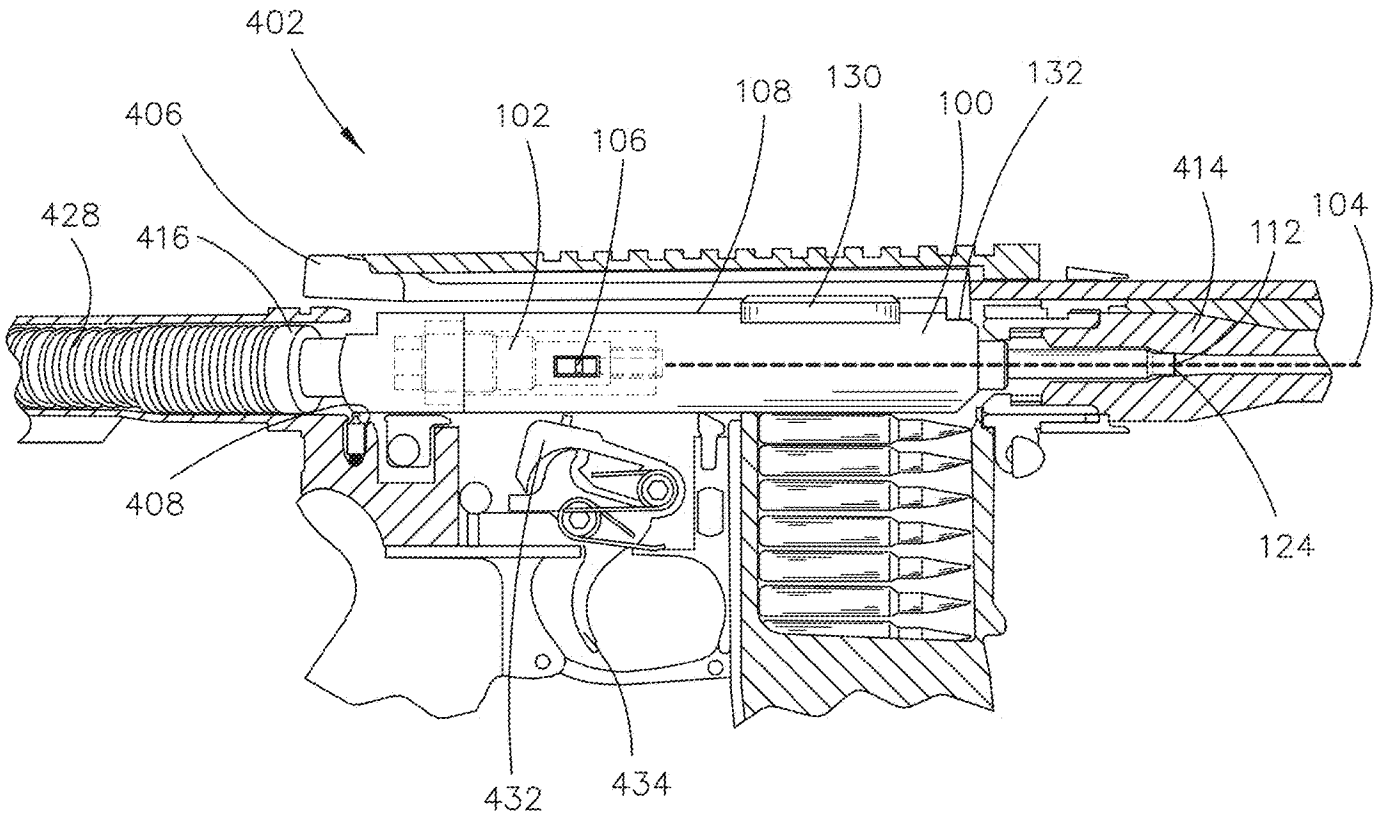
FIG. 6 is a cut-out view of a chamber illustrating a loaded boresight device, in accordance with one or more embodiments of the present disclosure.
Figure 7:
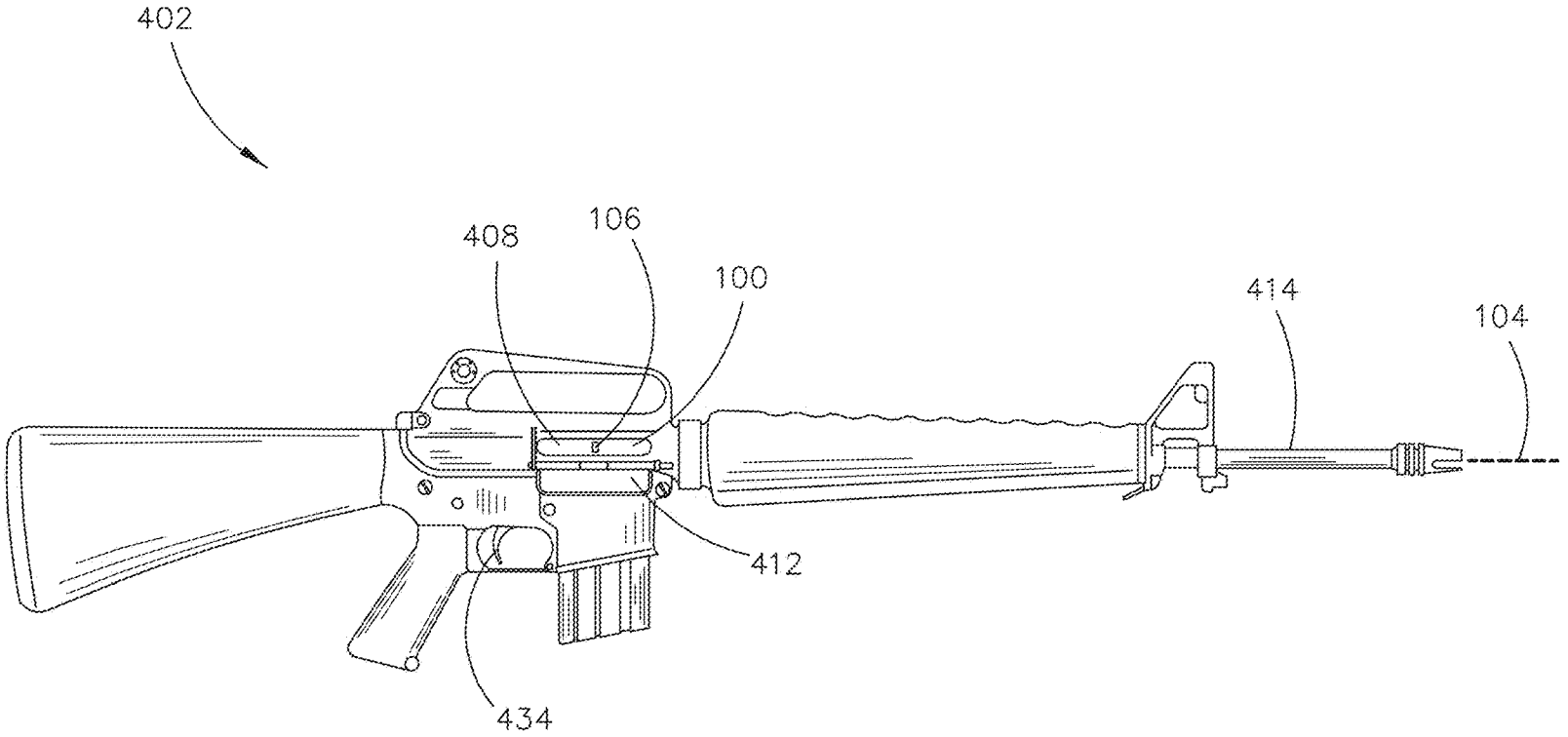
FIG. 7 is a side view of a firearm with a loaded boresight device, in accordance with one or more embodiments of the present disclosure.

Referring now generally to FIGS. 4 through 7, the coupling of a boresight device 100 with a chamber of an M-16-style firearm is shown. FIGS. 4 and 5 illustrate an M-16-style firearm suitable for receiving a boresight device 100. FIGS. 6 and 7 illustrate a boresight device 100 loaded within the firearm. It is to be understood, however, that FIGS. 4 through 7 and the accompanying descriptions are provided solely for illustrative purposes and should not be interpreted as limiting the present disclosure. The boresight device 100 may be designed to be loaded into the chamber of a firearm of any style and of any caliber. For example, the boresight device 100 may be designed to be loaded into any M-16 or AR-15 style firearm or derivatives thereof. By way of another example, the boresight device 100 may be designed to be loaded into additional styles of firearms without departing from the spirit and scope of the present disclosure.

FIG. 4 is an exploded side view of an M-16 firearm 402 in an opened position illustrating a bolt carrier group 404 and a charging handle 406 removed to provide access to a chamber 408 of the firearm, in accordance with one or more embodiments of the present disclosure. For example, the chamber 408 may be accessed by removing a locking pin 410, pivoting open the firearm 402, and removing the bolt carrier group 404 with the charging handle 406. In FIG. 4, a chamber door 412 is opened to view the interior of the chamber 408. FIG. 5 is a perspective cut-out view of an empty chamber 408 of a firearm 402, in accordance with one or more embodiments of the present disclosure.

In one embodiment, the boresight device 100 is designed to be loaded into the chamber 408 in the place of the bolt carrier group 404. For example, a user may use the charging handle 406 to insert and/or remove the boresight device 100 from the chamber 408 in the same manner as the bolt carrier group 404.

FIGS. 6 and 7 illustrate multiple views of the boresight device 100 loaded in the chamber 408 of the firearm 402 and the path of the laser beam 104 during operation. FIG. 6 is a cut-out view of the chamber 408 illustrating a loaded boresight device 100, in accordance with one or more embodiments of the present disclosure. FIG. 7 is a side view of the firearm 402 with a loaded boresight device 100, in accordance with one or more embodiments of the present disclosure.

In one embodiment, the chamber 408 may be bounded by the barrel 414 towards the firing end of the firearm 402, a recoil buffer 416 towards the butt of the firearm 402, and a chamber wall 418 on the sides.

In another embodiment, the boresight device 100 is designed to be loaded into the chamber of a firearm (e.g., firearm 402, or the like) such that the exit port 112 self-aligns with the axis of the barrel of the firearm upon loading. In this regard, the laser beam 104 generated by the laser device 102 may propagate along the axis of the barrel 414 and out the firing end of the barrel 414. A user may thus immediately align the laser beam 104 on a target at a selected distance and align a sighting device to the laser beam 104 to boresight the firearm without alignment of the laser device 102 to the barrel 414.

The boresight device 100 may include one or more keyed features to facilitate the alignment of the exit port 112 with the axis of the barrel of the firearm when loaded into the chamber 408.

In one embodiment, the one or more keyed features include the outer dimensions of the boresight device 100 (e.g., the outer dimensions of the casing 108. For example, the outer dimensions of the boresight device 100 (e.g., the casing 108) may correspond to those of the bolt carrier group 404 such that the boresight device 100 may be firmly secured into the chamber 408 in a fixed position. In this regard, the laser device 102 may be roughly the shape of a cylinder with a diameter approximating that of the bolt carrier group 404. Further, the length of the bolt carrier group 404 may correspond to the length of the chamber 408. In this regard, a front face 124 of the boresight device 100 including the exit port 112 may be proximate to or be in contact with the barrel 414, and a rear face 126 may be in contact with the recoil buffer 416.

In another embodiment, a portion of the boresight device 100 is designed to extend into the barrel 414 to facilitate self-alignment of the exit port 112 to the axis of the barrel 414 when loaded into the chamber 408. For example, the casing 108 may include (e.g., as one or more chamfered edges 128 designed to contact one or more interior portions of the barrel such as, but not limited to, an end face 420, one or more bolt grooves 422 (e.g., grooves designed to engage with a bolt during firing of the firearm 402), a bolt-receiving chamber 424, a bullet-receiving chamber 426, or the like. For example, a portion of the casing 108 may be formed in the shape of a bullet and may be configured to extend into the bullet-receiving chamber 426 of the barrel 414 to facilitate alignment of the boresight device 100 with the axis of the barrel 414. Further, a portion of the casing 108 designed in the shape of a bullet may be removable. In this regard, a user may customize the portion of the casing 108 designed in the shape of a bullet to accommodate firearms suitable for firing any caliber of bullet. In another embodiment, though not shown, the boresight device 100 is designed to be loaded into the chamber 408, but not protrude into the barrel 414.

In another embodiment, the rear face 126 of the boresight device 100 is designed to engage with the recoil buffer 416 such that a recoil spring 428 firmly secures the boresight device 100 in the chamber 408. Further, the boresight device 100 may contact portions of the chamber wall 418, the barrel 414, or the like to provide a secure fit and robust alignment.

In another embodiment, the boresight device 100 includes one or more keyed features (e.g., rails, grooves, protrusions, cut-outs, or the like) to engage with corresponding components of the firearm 402 to secure and/or align the boresight device 100 within the chamber 408. For instance, keyed features of the boresight device 100 may include a rail assembly 130 and/or a notch 132 to engage with the charging handle 406. In another instance, keyed features of the boresight device 100 may include a protrusion to engage with the gas return supply 430. In another instance, keyed features of the boresight device 100 may include one or more grooves to engage with bolt grooves 422. In another instance, keyed features of the boresight device 100 may include chamfered portions of the casing designed to extend into the barrel 414 to contact one or more portions of the interior of the barrel 414.

In another embodiment, the laser power actuator 106 is accessible to a user when the boresight device 100 is loaded within the chamber 408 of the firearm 402. For example, as illustrated in FIG. 6, the laser power actuator 106 may be accessible through the chamber door 412 when opened. By way of another example, the laser power actuator 106 may engage with the safety switch of the firearm 402. In this regard, a user may utilize the safety switch to toggle the laser beam 104 and/or adjust the beam intensity. By way of a further example, the laser power actuator 106 may engage with the hammer 432 of the firearm 402. In this regard, a user may toggle the laser beam 104 on and off by pulling the trigger 434.

In another embodiment, the boresight device 100 includes a pressure-sensitive switch located on the rear face 126 of the boresight device 100. Accordingly, pressure from the recoil buffer 416 provided by the recoil spring 428 when the boresight device 100 is loaded into the chamber 408 engage the pressure-sensitive switch. For example, the pressure-sensitive switch may toggle the laser beam 104 on only when the boresight device 100 is loaded and may toggle the laser beam 104 off otherwise. By way of another example, the pressure-sensitive switch may serve as a safety such that a user may only engage the laser power actuator 106 to toggle or adjust the intensity of the laser beam 104 only when the pressure-sensitive switch is engaged (e.g., when the boresight device 100 is loaded into the firearm 402).

In another embodiment, at least one laser positioning device 114 is accessible to a user when the boresight device 100 is loaded within the chamber 408 of the firearm 402. For example, the at least one laser positioning device 114 may be accessible through the chamber door 412 when opened. In this regard, a user may make adjustments of the alignment of the laser beam 104 to the barrel 414 if required. For example, it may be the case that the boresight device 100 may not properly self-align during loading such that the laser beam 104 does not propagate along the axis of the barrel 414. By way of another example, it may be the case that adjustments may be necessary based on the exact specifications of a particular firearm. Accordingly, a user may adjust the alignment as necessary.

Figure 8:
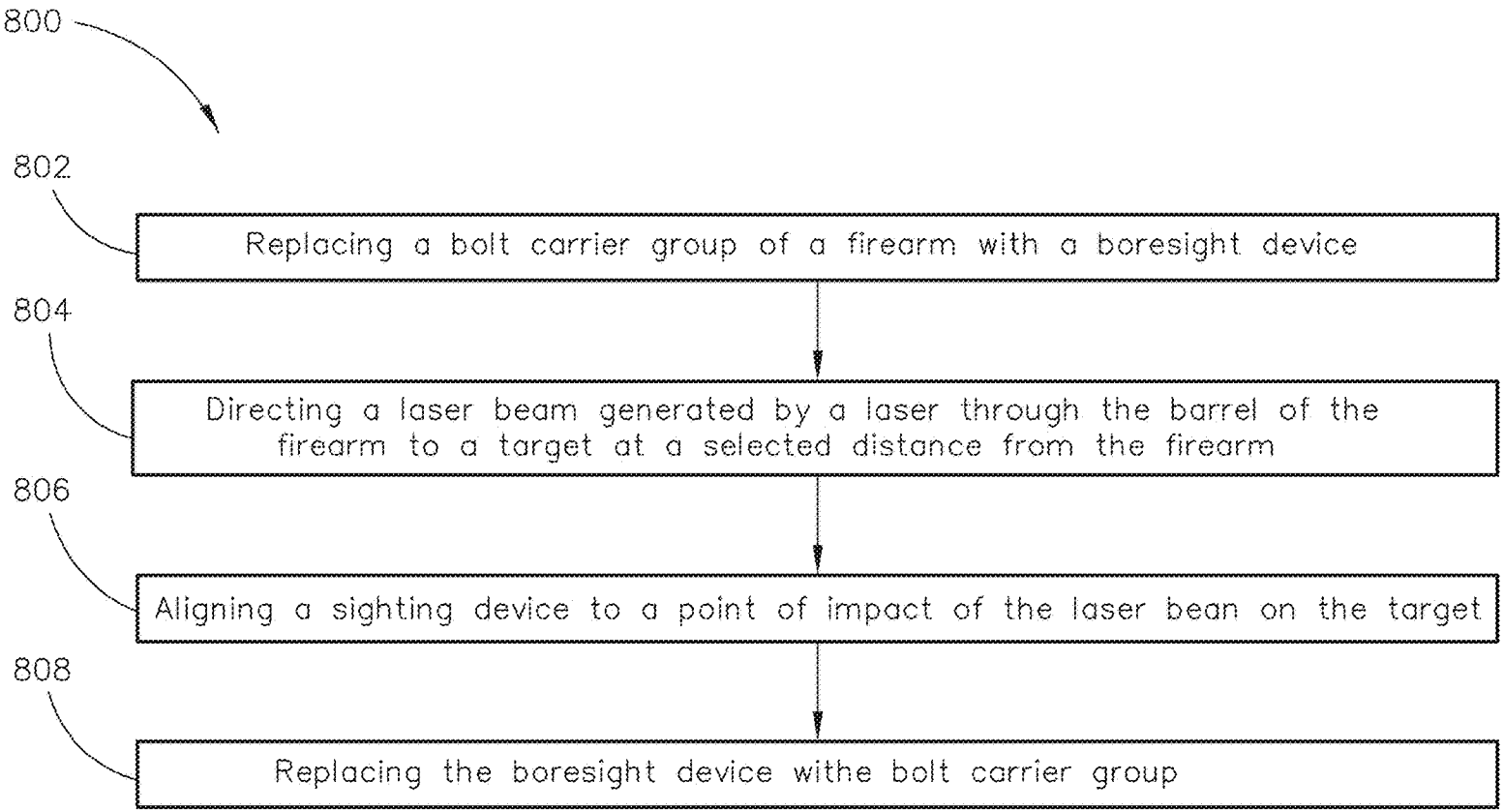
FIG. 8 is a flow diagram illustrating a method for boresighting a firearm using a boresight device, in accordance with one or more embodiments of the present disclosure.

FIG. 8 is a flow diagram illustrating a method 800 for boresighting a firearm using a boresight device, in accordance with one or more embodiments of the present disclosure. Applicant notes that the embodiments and enabling technologies described previously herein in the context of boresight device 100 should be interpreted to extend to method 800. It is further noted, however, that the method 800 is not limited to the architecture of boresight device 100.

In one embodiment, the method 800 includes a step 802 of replacing a bolt carrier group of a firearm with a boresight device (e.g., boresight device 100). For example, the boresight device may be loaded into the chamber in the place of a bolt carrier group. Accordingly, a user may first unload the bolt carrier group (e.g., with the charger handle), and replace the bolt carrier group with the boresight device.

In another embodiment, the boresight device includes a laser device for generating a laser beam and an exit port from which the laser beam may exit the boresight device. Further, the boresight device may self-align the exit port of the boresight device to the axis of the barrel when loaded into the chamber without requiring adjustment from the user. In this regard, the laser beam may propagate along the axis of the barrel and out the firing end of the barrel to indicate a direction at which the barrel is pointed. For example, the boresight device may have dimensions and/or keyed features designed to engage with components of the firearm during loading to align the exit port to the axis of the barrel.

In another embodiment, the method 800 includes a step 804 of directing a laser beam generated by a laser through the barrel of the firearm to a target at a selected distance from the firearm. In this regard, the user may establish the direction at which the barrel is pointed.

In another embodiment, the method 800 includes a step 806 of aligning a sighting device to a point of impact of the laser beam on the target. The user may thus align the sighting device to the barrel of the target.

In another embodiment, the method 800 includes a step 808 of replacing the boresight device with the bolt carrier group. After boresighting the firearm, the user may return the firearm to operational status such that the firearm is ready to fire ammunition. For example, the user may replace the boresight device with the bolt carrier group removed in step 802.

As necessary, the user may further zero the firearm at any distance using any method known in the art. For example, the user may fire one or more rounds of ammunition and adjust the sight to the point of impact. It is recognized herein that boresighting the firearm using method 800 prior to firing ammunition may improve the speed at which firearms may be zeroed and reduce the amount of ammunition wasted during the zeroing process.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected" or "coupled" to each other to achieve the desired functionality, and any two components capable of being so associated can also be viewed as being "couplable" to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A boresight device comprising:

a casing configured to be loaded into a chamber of a firearm in place of a bolt carrier group and secured with a recoil buffer, wherein the casing includes at least one keyed feature to engage with boundaries of the chamber to align an exit port in the casing to a barrel of the firearm without engaging a hammer of the firearm when the casing is loaded into the chamber and secured with the recoil buffer;

a laser device located in an interior cavity of the casing and positioned to direct a laser beam through the exit port and along the barrel when the casing is loaded into the chamber and secured with the recoil buffer, wherein the laser device is powered by at least one battery housed within the interior cavity of the casing;

a laser power actuator providing an interface for actuating the laser device; and a removable cap, wherein removal of the removable cap provides access for removal and insertion of at least one of the laser device or the at least one battery for powering the laser device.

2. The boresight device of claim 1, wherein the laser power actuator comprises:

an actuator positioned to be accessible through a chamber door of the firearm.

3. The boresight device of claim 1, wherein the at least one keyed feature includes a portion of the casing configured to extend into the barrel of the firearm and engage with an interior portion of the barrel.

4. The boresight device of claim 1, wherein the laser device is powered by at least one of an AA battery or an AAA battery.

5. The boresight device of claim 1, wherein the laser power actuator comprises:

an actuator located on a rear face of the casing, wherein the switch is configured to be engaged to activate the laser device by the recoil buffer when the casing is loaded into the chamber and secured with the recoil buffer.

6. A boresight device comprising:

a casing configured to be loaded into a chamber of a firearm in place of a bolt carrier group and secured with a recoil buffer, wherein the casing includes at least one keyed feature to engage with boundaries of the chamber to align an exit port in the casing to a barrel of the firearm without engaging a hammer of the firearm when the casing is loaded into the chamber and secured with the recoil buffer; and a laser device located in an interior cavity of the casing and positioned to direct a laser beam through the exit port of the casing and along the barrel when the casing is loaded into the chamber and secured by the recoil buffer.

7. The boresight device of claim 6, further comprising:

a laser power actuator providing an interface for actuating the laser device when the casing is loaded into the chamber.

8. The boresight device of claim 7, wherein the laser power actuator comprises:

an actuator positioned to be accessible through a chamber door of the firearm.

9. The boresight device of claim 7, wherein the laser power actuator comprises:

an actuator positioned to be triggered by a hammer of the firearm upon pulling of a trigger of the firearm.

10. The boresight device of claim 6, wherein the at least one keyed feature engages with at least one of a charging handle of the firearm, a gas return line of the firearm, at least one bolt groove on the barrel, a bolt-receiving chamber of the barrel, or a bullet-receiving chamber of the barrel.

11. The boresight device of claim 6, further comprising:

at least one laser positioning device providing an interface for adjusting a path of the laser beam when the casing is loaded into the chamber.

12. The boresight device of claim 6, wherein the casing further comprises:

a removable cap, wherein removal of the removable cap provides access for removal and insertion of at least one of the laser device or at least one battery for powering the laser device.

13. The boresight device of claim 6, wherein the laser device is powered by at least one of an AA battery or an AAA battery.

14. A boresight device comprising:

a casing configured to be loaded into a chamber of a firearm in place of a bolt carrier group and secured with a recoil buffer, wherein the casing is configured to accept a laser device for generating a laser beam within an interior cavity of the casing, wherein the casing includes at least one keyed feature to engage with boundaries of the chamber to corresponding align an exit port in the casing to a barrel of the firearm when the casing is loaded into the chamber and secured with the recoil buffer such that the laser beam propagates through the exit port and along the barrel.

15. The boresight device of claim 14, wherein the casing further comprises:

a removable cap, wherein removal of the removable cap provides access for removal and insertion of at least one of the laser device or at least one battery for powering the laser device.

16. The boresight device of claim 14, further comprising:

a guide lug configured to fit within the casing and further configured to accept at least a portion of the laser device.

17. The boresight device of claim 14, further comprising:

a laser power actuator providing an interface for actuating the laser device when the casing is loaded into the chamber.

18. The boresight device of claim 14, further comprising:

at least one laser positioning device providing an interface for adjusting a path of the laser beam when the casing is loaded into the chamber.

19. The boresight device of claim 14, wherein the at least one keyed feature comprises:

outer dimensions of the casing configured to engage with the boundaries of the chamber when the casing is loaded into the chamber and secured with the recoil buffer.

20. The boresight device of claim 14, wherein the at least one keyed feature engages with at least one of a charging handle of the firearm, a gas return line of the firearm, at least one bolt groove on the barrel, a bolt-receiving chamber of the barrel, or a bullet-receiving chamber of the barrel.

* * * * *